US008043388B2

(12) United States Patent
Waters et al.

(10) Patent No.: US 8,043,388 B2
(45) Date of Patent: Oct. 25, 2011

(54) GRAFTED POLYMER DRAG-REDUCING AGENTS, GRAFTED POLYMER FUEL ADDITIVES AND PRODUCTION METHODS THEREFOR

(75) Inventors: Paul F. Waters, Washington, DC (US); John B. Waters, Washington, DC (US)

(73) Assignee: Himmelsbach Holdings, LLC, Washington, DC (US)

( * ) Notice: Subject to any disclaimer, the term of this patent is extended or adjusted under 35 U.S.C. 154(b) by 0 days.

(21) Appl. No.: 12/848,698

(22) Filed: Aug. 2, 2010

(65) Prior Publication Data

US 2010/0297565 A1 Nov. 25, 2010

Related U.S. Application Data

(63) Continuation of application No. 11/610,326, filed on Dec. 13, 2006, now abandoned.

(60) Provisional application No. 60/749,700, filed on Dec. 13, 2005.

(51) Int. Cl.
*C10L 1/196* (2006.01)
*C10L 1/195* (2006.01)
*F23N 1/02* (2006.01)

(52) U.S. Cl. ..... 44/641; 44/393; 44/459; 431/12

(58) Field of Classification Search ..... 427/223; 210/693; 525/322, 240; 457/44; 508/234, 508/221; 44/457, 393, 459, 641; 431/12
See application file for complete search history.

(56) References Cited

U.S. PATENT DOCUMENTS

| | | | | |
|---|---|---|---|---|
| 3,243,481 | A | | 3/1966 | Ruffing et al. |
| 3,475,514 | A | | 10/1969 | Nemphos et al. |
| 3,723,575 | A | | 3/1973 | Kern et al. |
| 4,026,167 | A | | 5/1977 | Archer |
| 4,085,055 | A | | 4/1978 | Durand et al. |
| 4,181,618 | A | | 1/1980 | Durand et al. |
| 4,340,076 | A | | 7/1982 | Weitzen |
| 4,440,916 | A | | 4/1984 | Waters et al. |
| 4,476,283 | A | | 10/1984 | Andersen |
| 4,678,834 | A | | 7/1987 | Boivin et al. |
| 4,789,383 | A | | 12/1988 | O'Mara et al. |
| 4,923,535 | A | | 5/1990 | Waters et al. |
| 4,981,535 | A | | 1/1991 | Hadermann et al. |
| 5,000,803 | A | | 3/1991 | Hadermann et al. |
| 5,030,394 | A | | 7/1991 | Sietses et al. |
| 5,220,107 | A | | 6/1993 | Kubacki |
| 5,247,052 | A | | 9/1993 | Lucke et al. |
| 5,268,110 | A | * | 12/1993 | Fuisz ..... 210/693 |
| 5,510,429 | A | | 4/1996 | Lee et al. |
| 5,539,044 | A | | 7/1996 | Dindi et al. |
| 5,571,869 | A | * | 11/1996 | Lee et al. ..... 525/322 |
| 5,656,205 | A | | 8/1997 | Rabolt et al. |
| 5,906,665 | A | | 5/1999 | Trippe et al. |
| 6,172,151 | B1 | | 1/2001 | Johnston et al. |
| 6,368,369 | B1 | | 4/2002 | Sanduja et al. |
| 6,399,676 | B1 | | 6/2002 | Labude et al. |
| 6,576,732 | B1 | | 6/2003 | Milligan et al. |
| 6,706,320 | B2 | | 3/2004 | Filippou et al. |
| 6,765,053 | B2 | | 7/2004 | Labude et al. |
| 6,989,357 | B2 | | 1/2006 | Eaton et al. |
| 7,261,747 | B2 | * | 8/2007 | Waynick ..... 44/457 |
| 2003/0207773 | A1 | * | 11/2003 | Lange et al. ..... 508/234 |
| 2004/0034168 | A1 | * | 2/2004 | Schauder ..... 525/240 |
| 2005/0153849 | A1 | * | 7/2005 | Mishra et al. ..... 508/221 |

OTHER PUBLICATIONS

Removal of Drag Reducer Additive From Petroleum Fuels, Part 2: Effect of Fuel and Polymer Structure, IASH 2003, the 8th International Conference on Stability and Handling of Liquid Fuels, Steamboat Springs, Colorado, Sep. 14-19, 2003.

* cited by examiner

*Primary Examiner* — Michael Marcheschi
*Assistant Examiner* — Chantel Graham
(74) *Attorney, Agent, or Firm* — Fredrikson & Byron, P.A.

(57) ABSTRACT

The invention includes a method of reducing drag in a pipeline and/or improving the combustion efficiency of a fuel burning device by adding a grafted polymer to a hydrocarbon product. The invention also includes a method of improving the combustion efficiency of a gasoline engine by adding a grafted polymer to fuel and combusting the fuel within the gasoline engine, the grafted polymer having a viscoelastic effect in gasoline in the gasoline engine to generally correspond to a duration of the intake stroke/compression stroke/fuel burn sequence in a gasoline engine.

20 Claims, No Drawings

GRAFTED POLYMER DRAG-REDUCING AGENTS, GRAFTED POLYMER FUEL ADDITIVES AND PRODUCTION METHODS THEREFOR

RELATED APPLICATIONS

This application claims the benefit of U.S. patent application Ser. No. 11/610,326, filed Dec. 13, 2006, and U.S. Provisional Application Ser. No. 60/749,700, filed Dec. 13, 2005, and titled Grafted Polymer Drag-Reducing Agents, Grafted Polymer Fuel Additives, and Production Methods Therefor, the contents of which are hereby incorporated by reference.

FIELD OF THE INVENTION

The invention generally relates to improving the flow of hydrocarbons through conduits, particularly pipelines, as well as to improving the combustion efficiency of a fuel-burning device. More specifically, the invention relates to grafted polymers so produced as improved drag-reducing agents, as well as to grafted polymers so produced as improved fuel additives used to improve the combustion efficiency of a fuel-burning device.

BACKGROUND OF THE INVENTION

A drag-reducing agent (DRA) is one that substantially reduces the friction loss that results from the turbulent flow of a fluid, and thereby increases the flow capability of pipelines, hoses and other conduits in which liquids flow. Certain polymers are known to function as DRAs, particularly in hydrocarbon liquids. Such polymers may be dissolved in hydrocarbon liquids in order, for example, to increase liquid flow, to provide for the use of a smaller diameter pipe for a given flow capacity, or to reduce the cost of pumping hydrocarbon liquids.

A method of improving the combustion efficiency of a fuel-burning device is to add an appropriate polymer to the fuel of the fuel-burning device and to burn the fuel with the polymer in the fuel-burning device. In general, the improvement in combustion efficiency of a four-cycle diesel engine operating on traditional polymeric-additive-treated diesel fuel vs. neat diesel fuel is superior to the improvement in combustion efficiency of a four-cycle gasoline engine operating on traditional polymeric-additive-treated gasoline vs. neat gasoline. Whereas the superior improvement in combustion efficiency of a diesel engine operating on traditional polymeric-additive-treated diesel fuel depends in part upon the molecular weight of the polymer, the efficiency of a polymer fuel additive, as well as the efficiency of a polymer DRA, depends more specifically upon the polymer's viscoelastic properties.

SUMMARY OF THE INVENTION

Some embodiments of the invention are directed to methods of improving the flow of hydrocarbon liquids through a pipeline or other conduit. The methods preferably include the steps of introducing a grafted polymer into a pipeline or other conduit with flowing hydrocarbons.

In addition, some embodiments of the invention include a method of improving the combustion efficiency of a fuel-burning device, including the steps of adding a grafted polymer to the fuel of the fuel-burning device and burning the fuel with the grafted polymer in the fuel-burning device.

Further, some embodiments of the invention include improving the combustion efficiency of a gasoline engine by adding a grafted polymer to fuel and combusting the fuel in the gasoline engine, the grafted polymer having a strain-and-relaxation cycle in the fuel that generally corresponds to a duration of the intake stroke/compression stroke/fuel burn sequence in the gasoline engine.

The grafted polymers may be produced by any appropriate method of grafting monomers to preformed polymers, such as by cryogenic synthesis, radiation (e.g., ultraviolet or microwave radiation), chemical reaction (e.g., reaction with organic peroxides or hydroperoxides), extrusion, flaming, and/or oxidation.

The term, "polymer," may include any appropriate polymer, copolymer, terpolymer or combination of monomers. The term, "grafted polymer," may include a polymer grafted by any method, whether cryogenically or otherwise, in accordance with the present invention. The term, "grafted polymer," may also include a grafted polymer distributed in a carrier, whether liquid or otherwise, where such grafted polymer distributed in a carrier is appropriate for adding to hydrocarbons flowing in a pipeline or other conduit, and/or where such grafted polymer distributed in a carrier is appropriate for adding to fuel.

DETAILED DESCRIPTION OF THE INVENTION

For the purpose of promoting an understanding of the principles of the present invention, reference will now be made to the embodiments and specific language will be used to describe the same. It will, nevertheless, be understood that no limitation of the scope of the invention is thereby intended; any alterations and further modifications of the described or illustrated embodiments, and any further applications of the principles of the invention as illustrated therein, are contemplated as would normally occur to one skilled in the art to which the invention relates.

The process of grafting, whereby side chains are attached to a host polymer, can be initiated by a variety of methods. If the side chains comprise similar monomer units to the host polymer, then the polymer is referred to as a grafted homopolymer; if the side chains comprise dissimilar monomer units to the host polymer, then the polymer is referred to as a grafted copolymer. A grafted polymer has distinctly different properties from those of the original polymer. Monomers grafted to a polymer backbone can produce marked differences in its chemical and physicochemical behavior. With respect to the present invention, whereas a normal random-coil polymer molecule in solution exhibits a volume and a root mean square end-to-end distance relative to its solubility parameter, molecular weight, and temperature in a given solvent, a grafted polymer includes polymeric branches that emanate from the backbone of the molecule. These branches may themselves be random coils, or they may exist as near-linear protrusions, imparting significant volume relative to the added mass, and, in particular, providing steric hindrance to the molecular strain and relaxation of the molecule as a whole, thereby modifying the duration of the polymer's viscoelastic effect. As a result, a grafted polymer as described herein can, for example, provide more effective drag reduction in a hydrocarbon liquid than its non-grafted parent at the same molecular weight.

Among the different grafting techniques, some embodiments of the invention include a graft polymerization induced by cryogrinding. Cryogrinding a polymer with another polymer or polymers at cryogenic temperatures is discussed, for example, in U.S. Pat. No. 4,440,916 (the '916 patent), the contents of which are hereby incorporated by reference. In general, cryogrinding includes grinding a polymer backbone in a vessel containing, for example, liquid nitrogen, and adding to the vessel a monomer for grafting. Graft polymerization induced by cryogrinding consists of cooling a polymer below its glass-transition temperature and fracturing the embrittled polymer mechanically to generate polymer free radicals. The cryoground polymer is then reacted, for example, with a monomer, at temperatures ranging from cryogenic up to the highest, useful temperatures. In some embodiments, the monomer may be suspended in an inert solvent to control the rate of reaction and/or the reaction may take place with the monomer above cryogenic temperatures. Further, the method may include cryogrinding the polymer and reacting the cryoground polymer with a second cryoground polymer at cryogenic temperatures in the presence of initiators.

In some embodiments, the method of producing a grafted polymer includes cryogrinding a polymer and reacting the cryoground polymer with a monomer. In the cryofracturing process, electrons are produced in the polymer, forming polymer free radicals. In polyisobutylene (PIB), for example, the most likely sites for the formation of free radicals result from sigma-bond cleavage between the carbon atom of the $CH_3$ group and the carbon atom in the backbone to which it is joined, or at the CH bond of the $CH_3$ group. If one or more sites are produced on a single molecule, and the sites subsequently initiate a propagation step of polymerization, then branching results. Given that little deterioration of polymer molecular weight occurs in the cryogrinding process, few backbone carbon-atom bonds are broken and the fracture planes are likely to propagate randomly in the amorphous material. In the single-site case, simple one-on-one grafting occurs, leading to a branched chain.

The cryoground polymer in a cryogenic vehicle may be made to contact other reactants at any suitable temperature, but the cryofractured polymer is itself generally below its glass-transition temperature and protected from the environment in, for example, liquid nitrogen. In some embodiments, the mixing of the reactants may be carried out at above cryogenic temperatures. Higher temperatures at which polymer free radicals may react with monomers range from the melting point of the monomer up to the highest useful temperatures, including those at which the monomer may be a gas. Mixing at higher temperatures provides several processing advantages over mixing at cryogenic temperatures. For example, to the extent that materials require less cooling, less energy may be consumed.

In principle, graft polymerization induced by cryogrinding is possible for any polymer reacted with any vinyl monomer. In some embodiments, a grafted polymer may be generated by reacting cryoground PIB with isobutylene monomer, with or without a coupling agent intermediate.

Methods in accordance with the invention including the admixing of cryoground polymers with monomers or combinations thereof are superior methods for producing a wide range of grafted polymers, particularly copolymers of monomers that are difficult to copolymerize using conventional methods due to their different reactivity ratios. Further, without being limited to any particular theory of operation, the effectiveness of the present invention is related to a grafted polymer's improved viscoelastic effect. Specifically, the effectiveness of a polymer in improving the flow of hydrocarbons through conduits, as well as the effectiveness of a polymer in improving the combustion efficiency of a fuel-burning device, is related to the polymer's viscoelastic control of the phenomena of cavitation and droplet formation, respectively. A traditional method of improving a polymer's viscoelastic effect is to increase the polymer's molecular weight. However, there appears to be an upper limit with respect to the molecular weight for polymers whose molecular weight increases with decreasing temperature. For example, high molecular weight PIB can be produced using carbocation initiators at cryogenic temperatures; however, there is an upper limit with respect to molecular weight for the polymerization of isobutylene. Therefore, in the case of PIB, the traditional approach to increasing a polymer's viscoelastic effect, namely, by increasing the polymer's molecular weight by polymerization, appears to be limited by the maximum achievable molecular weight for the polymerization of isobutylene.

The present invention contemplates adding branches to the backbone of a polymer. Specifically, the branches are added in order to modify the polymer's strain-and-relaxation cycle when subjected to hydrodynamic stress in solution, thereby prolonging the polymer's viscoelastic effect.

Some embodiments of the invention include a method of preparing a grafted polymer so produced as an improved drag-reducing agent and/or an improved fuel additive, comprising grafting a polymer in order to modify the polymer's strain-and-relaxation cycle when subjected to hydrodynamic stress in solution, thereby prolonging the polymer's viscoelastic effect. In some embodiments the invention includes grafting a polymer by grafting polymer branches to the polymer backbone in order to modify the polymer's strain-and-relaxation cycle when subjected to hydrodynamic stress in solution, thereby prolonging the polymer's viscoelastic effect. For example, embodiments of the invention include grafting PIB by grafting polymer branches to a PIB backbone.

Generally, in some embodiments, a grafted polymer may have a molecular weight of more than about 50,000 Daltons (e.g., more than about 1 million Daltons), up to about 50 million Daltons. The molecular weight of the grafted polymer may be determined in a variety of ways, such as by light scattering photometry.

In some embodiments of the invention, a polymer may be grafted by appending an optimum number of branches according to the configuration of other variables such as the concentration of the polymer in solution and/or the aerosolization technique in the system. The optimum number of branches in such a grafted polymer may be determined by the need for balance between the tendency of the polymer, in relation to the number of branches added, toward a strain-and-relaxation cycle of increased duration, and the limit of that increase imposed, for example, by the tendency of some such polymers to resist viscoelastic expansion as a result of steric interference.

In some embodiments of the invention, the grafted polymer is configured structurally, for example, by grafting to a polymer backbone long chains of monomers which form polymers that unzip or degrade thermally primarily to monomer, which readily burn in an internal combustion engine. For example, the polymer may unzip to about 80% monomer. Such molecules exhibit complex strain-and-relaxation, time-dependent profiles, thereby modifying the duration of the viscoelastic effect. Examples of suitable monomers include methyl methacrylate, ethyl methacrylate, 2-hydroxyethyl methacrylate, styrene, alpha methylstyrene, isobutylene, and in-situ formed copolymers of such monomers, which may be randomly grafted to a backbone of available molecules to produce a randomly-branched molecule. In addition, any suitable number of branches may be grafted to the polymer backbone. For example, about 2 to about 4 branches can be grafted to the polymer backbone. Further, each branch can be of any appropriate size. For example, each branch can include about 2 to about 50 carbon atoms.

The backbone of the grafted polymer can include any suitable polymer, including any suitable unzipping elastomer, at any appropriate molecular weight. For example, the backbone may include an unzipping elastomer, such as PIB, at a molecular weight of about 50,000 Daltons to about 15 million Daltons.

Without intending to be bound by theory, PIB has several properties that make it a preferred polymer backbone with respect to producing a viscoelastic effect in hydrocarbon liquids. For example, PIB is linear, with pairs of methyl groups attached to the alternate backbone carbon atoms of the polymer chain. When subjected to hydrodynamic stress in solution, the symmetrical structure of PIB allows for a highly-efficient, relatively hindrance-free, extension of the molecular chain. In contrast, the strain-and-relaxation cycle of a typical comb polymer is marked by steric hindrance. Consequently, at the same concentration in solution, the molecular weight of a comb polymer DRA of comparable drag-reduction effectiveness is generally significantly higher than the molecular weight of a PIB DRA. Comb polymer DRAs, such as those synthesized by the method described in U.S. Pat. No. 5,539,044, are generally polyalkenes having 2 to about 30 carbon atoms per alkene precursor and an inherent viscosity of at least about 20 deciliters per gram, typically up to the 50 megadalton viscosity average molecular weight range. Moreover, ultra high molecular weight comb polymers of the type described, for example, in U.S. Pat. No. 5,539,044, generally do not unzip upon thermal degradation; rather, they degrade chaotically into random-size fragments that burn at various rates, and, consequently, tend to form gums upon combustion. In contrast, when PIB, grafted in accordance with the present invention, is used in fuel pipelines carrying, for example, jet fuel, diesel fuel, gasoline, naphtha, or fuel oil, it unzips primarily to monomer and other hydrocarbon species, all of which burn readily in internal combustion engines.

In some embodiments, the invention includes a method of improving the flow of hydrocarbons through a pipeline or other conduit, including the steps of adding a grafted polymer to a hydrocarbon flowing in a pipeline or other conduit in order to delay the onset of cavitation—the bubble formation that results in "pipeline drag"—in the flowing liquid.

The grafted polymer may be added to flowing hydrocarbons in any concentration suitable to be effective in improving their flow through a pipeline or other conduit. In some embodiments, the grafted polymer is added to the flowing hydrocarbons in a concentration range of about 0.1 to about 100 ppm by weight (e.g., about 60 ppm to about 80 ppm). In other embodiments, the grafted polymer is added to the flowing hydrocarbons in a concentration range of about 1 to about 60 ppm by weight (e.g., about 30 ppm to about 40 ppm). In other embodiments, the grafted polymer is added to the flowing hydrocarbons in a concentration range of about 1 to about 20 ppm by weight (e.g., about 12 ppm to about 15 ppm). In other embodiments, the grafted polymer is added to the flowing hydrocarbons in a concentration range of about 1 to about 10 ppm by weight (e.g., about 10 ppm). In yet other embodiments, the grafted polymer is added to the flowing hydrocarbons in a concentration range of about 1 to about 5 ppm by weight (e.g., about 5 ppm). In still other embodiments, the grafted polymer is added to the flowing hydrocarbons in a concentration range of about 0.1 to about 1 ppm by weight (e.g., about 1 ppm).

Such grafted polymers used as DRAs provide several advantages. For example, such grafted polymers will not contaminate a hydrocarbon product transmission pipeline. With respect to pipelines used to carry crude, while any DRA added to crude is likely to be fully degraded during the refining process, the pipeline used to carry the crude may also be used to carry finished fuel products. In such a case, a DRA added to the crude may still be present in the pipeline and dissolve in the finished fuel. Many prior art DRAs, if dissolved in finished fuel products, are considered contaminants as they have been found to leave performance limiting deposits in internal combustion engines. In contrast, grafted polymer DRAs as described herein will thermally degrade, or unzip, during the combustion cycle of an internal combustion engine and burn cleanly. Accordingly, they will not have to be removed from the finished fuel before it is combusted.

Moreover, as the grafted polymer DRAs as described herein will thermally degrade, or unzip, during the combustion cycle of an internal combustion engine and burn cleanly, they can be added to finished hydrocarbon fuels to reduce drag during transmission and do not need to be removed or degraded prior to being introduced to an internal combustion engine.

Further, the grafted polymers described herein actually improve the combustion efficiency of a fuel burning device. Some embodiments of the invention include a method of improving the combustion efficiency of a fuel burning device by adding the grafted polymer to fuel and combusting the fuel in the fuel burning device. When the grafted polymer is introduced into the fuel charge of a fuel-burning device the fuel becomes viscoelastic. The viscoelasticity imparted to the fuel results in a more uniform air/fuel mixture and, thus, more efficient combustion when compared to neat fuel. This, in turn, produces lower overall temperatures, antiknock performance, higher peak pressure, increased torque, greater fuel economy—especially during transients—and a reduction in harmful emissions.

The grafted polymer itself may be as described above and may be added to the fuel in any concentration suitable to be effective in increasing combustion efficiency. In some embodiments, the grafted polymer is added to the fuel in a concentration range of about 0.1 to about 100 ppm by weight (e.g., about 60 ppm to about 80 ppm). In other embodiments, the grafted polymer is added to the fuel in a concentration range of about 1 to about 60 ppm by weight (e.g., about 30 ppm to about 40 ppm). In other embodiments, the grafted polymer is added to the fuel in a concentration range of about 1 to about 20 ppm by weight (e.g., about 12 ppm to about 15 ppm). In other embodiments, the grafted polymer is added to the fuel in a concentration range of about 1 to about 10 ppm by weight (e.g., about 10 ppm). In yet other embodiments, the grafted polymer is added to the fuel in a concentration range of about 1 to about 5 ppm by weight (e.g., about 5 ppm). In still other embodiments, the grafted polymer is added to the fuel in a concentration range of about 0.1 to about 1 ppm by weight (e.g., about 1 ppm).

The fuel-burning device may be any device capable of burning fuel. In some embodiments, the fuel-burning device is selected from the group consisting of gasoline engines, diesel engines, jet engines, marine engines, furnaces, boilers, and burners. Further, such fuel-burning devices may not require structural modifications (e.g., modifying a fuel injector spray angle, or nozzle, or orifice diameter) to burn the fuel and the grafted polymer.

The grafted polymer may be added to the fuel at any suitable time. In some embodiments, the grafted polymer is added to a fuel tank of the fuel-burning device that contains fuel, either separate from or simultaneous with the fuel. In other embodiments, the grafted polymer is metered into the fuel system of the fuel-burning device by an additive injection system. In yet other embodiments, the grafted polymer is added to the fuel prior to adding the fuel to the tank of the fuel-burning device, including at the refinery.

The fuel may comprise any combustible liquid hydrocarbon, including, for example, gasoline of all octane ratings (e.g., leaded and unleaded and/or MTBE and ethanol-containing grades), diesel (e.g., low sulfur diesel, ultra low sulfur diesel, Fischer-Tropsch diesel, biodiesel, and/or off-road diesel), jet fuel (e.g., Jet A, JP-4, JP-5, and/or JP-8), marine fuel (e.g., IFO 180, IFO 380, MDO, and/or MGO), aviation turbine fuel, or fuel oil, including a No. 2 distillate or a No. 6 residual fuel.

Some embodiments of the invention include a method of improving the combustion efficiency of a gasoline engine comprising adding a grafted polymer to fuel and combusting the fuel in the gasoline engine. For traditional polymeric additives, the improvement in combustion efficiency of a diesel engine operating on traditional polymeric-additive-treated diesel fuel vs. neat diesel fuel is generally superior to the improvement in combustion efficiency of a gasoline engine operating on traditional polymeric-additive-treated gasoline vs. neat gasoline. The greater combustion efficiency improvement in diesel engines operating on traditional polymeric-additive-treated diesel fuel appears to be due to the closer correspondence between the duration of the strain-and-relaxation cycle—and so the viscoelastic effect—of a traditional polymeric additive in diesel fuel in a diesel engine and the duration of the fuel burn in a diesel engine.

Without intending to be bound by theory, in the four-cycle diesel engine, traditional polymeric-additive-treated diesel fuel may be injected into hot compressed air at a few crank-angle degrees before the piston reaches top dead center (TDC). The duration of the polymer's strain-and-relaxation cycle—source of the viscoelastic effect of the polymer in the fuel—is estimated to be about 15 milliseconds (ms), by which time, at 2000 RPM, the fuel has almost completely burned. In contrast, in a dual cam gasoline engine at 2000 RPM, the duration of the intake stroke alone is about 15 ms; an additional about 15 ms elapses before the piston reaches TDC. In order for the duration of the viscoelastic effect of a polymer in gasoline in a gasoline engine to be as effective as the viscoelastic effect of a polymer in diesel fuel in a diesel engine, its duration would have to more nearly correspond to the duration of the intake stroke/compression stroke/fuel burn sequence in a gasoline engine. Therefore, in order for a polymer to have a viscoelastic effect in gasoline in a gasoline engine comparable to the viscoelastic effect of a polymer in diesel fuel in a diesel engine, the duration of the viscoelastic effect of the polymer in gasoline in a gasoline engine would have to approach about 30 ms to about 40 ms.

In some embodiments, a polymer is grafted so that its strain-and-relaxation cycle—and so its viscoelastic effect—in gasoline generally corresponds to the duration of the intake stroke/compression stroke/fuel burn sequence in a gasoline-burning reciprocating internal combustion engine. In such embodiments, the increased duration of the viscoelastic effect of the grafted polymer improves the combustion efficiency of a gasoline engine when compared to the combustion efficiency of a gasoline engine operating on traditional polymeric-additive-treated gasoline. A grafted polymer, as described herein, added to gasoline, produces more efficient combustion in a gasoline engine. This, in turn, results in lower overall temperatures, improved antiknock performance, higher peak pressure, increased torque, greater fuel economy-especially during transients—and a greater reduction in harmful emissions.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations, which fall within the spirit and broad scope of the claims below.

What is claimed is:

1. A method of improving the combustion efficiency of a fuel burning device, the method comprising:

introducing a liquid hydrocarbon product and a grafted polymer to a fuel burning device, the hydrocarbon product and grafted polymer having been transported through a pipeline prior to introduction to the fuel burning device, wherein the grafted polymer is dispersed in the hydrocarbon product and has a polymeric backbone and grafted branches extending from the backbone; the grafted polymer further having a structure that unzips upon thermal degradation; and combusting the hydrocarbon product and the grafted polymer in the fuel burning device, the grafted polymer increasing the combustion efficiency of the fuel burning device.

2. The method of claim 1, wherein the hydrocarbon product is crude.

3. The method of claim 1, wherein the hydrocarbon product is a finished fuel.

4. The method of claim 1, wherein the grafted polymer is synthesized by grafting polymer branches on preformed polymers.

5. The method of claim 1, wherein the grafted polymer is synthesized by cryogrinding a polymer backbone at cryogenic temperatures and reacting the cryoground polymer backbone with a monomer or second polymer.

6. The method of claim 5, wherein the polymer backbone is an elastomer which degrades thermally by unzipping.

7. The method of claim 5, wherein the polymer backbone is PIB.

8. The method of claim 5, wherein the monomer is selected from the group consisting of methyl methacrylate, isobutylene, ethyl methacrylate, 2-hydroxyethyl methacrylate, styrene, and alpha methylstyrene.

9. The method of claim 1, wherein the fuel burning device is selected from the group consisting of internal combustion engines, furnaces, and boilers.

10. The method of claim 1, wherein the hydrocarbon product includes an aviation turbine fuel.

11. A method of reducing drag in a pipeline, the method comprising:

providing a grafted polymer having a polymeric backbone and grafted branches extending from the backbone, the grafted polymer further having a structure that unzips upon thermal degradation;

introducing the grafted polymer in a liquid hydrocarbon product pipeline, such that the grafted polymer is dispersed in the liquid hydrocarbon product; and transporting the hydrocarbon product and the grafted polymer in the pipeline, the grafted polymer reducing the drag in the pipeline.

12. The method of claim 11, wherein the hydrocarbon product is crude.

13. The method of claim 11, wherein the hydrocarbon product is a finished fuel.

14. The method of claim 11, wherein the grafted polymer is synthesized by grafting polymer branches on preformed polymers.

15. The method of claim 11, wherein the grafted polymer is synthesized by cryogrinding a polymer backbone at cryogenic temperatures and reacting the cryoground polymer backbone with a monomer or second polymer.

16. The method of claim 15, wherein the polymer backbone is an elastomer which degrades thermally by unzipping.

17. The method of claim 15, wherein the polymer backbone is PIB.

18. The method of claim 15, wherein the monomer is selected from the group consisting of methyl methacrylate, isobutylene, ethyl methacrylate, 2-hydroxyethyl methacrylate, styrene, and alpha methylstyrene.

19. The method of claim 11, further including combusting the hydrocarbon product and the grafted polymer in a fuel burning device, wherein the fuel burning device is selected from the group consisting of internal combustion engines, furnaces, and boilers.

20. The method of claim 11, wherein the hydrocarbon product includes an aviation turbine fuel.

* * * * *